United States Patent [19]

Yakich

[11] Patent Number: 4,521,675

[45] Date of Patent: Jun. 4, 1985

[54] CRIBBAGE BOARD

[76] Inventor: Joseph Yakich, Box 43, Batchawana Bay, Ont., Canada, P0S 1A0

[21] Appl. No.: 507,621

[22] Filed: Jun. 24, 1983

[30] Foreign Application Priority Data

Jan. 17, 1983 [CA] Canada ..... 419561

[51] Int. Cl.[3] ..... A63F 1/18

[52] U.S. Cl. ..... 235/90; 273/148 R

[58] Field of Search ..... 235/90; 116/325, 326; 273/148 R

[56] References Cited

U.S. PATENT DOCUMENTS

| | | | |
|---|---|---|---|
| D. 170,120 | 8/1953 | Isserstedt | 235/90 X |
| 2,323,371 | 7/1943 | Brown | 235/90 X |
| 2,531,589 | 11/1950 | Swift | 235/90 |
| 2,536,188 | 1/1951 | Kulakusky | 235/90 |
| 2,594,943 | 4/1952 | Logan | 235/90 |
| 2,605,966 | 8/1952 | Stackhouse | 235/90 |
| 2,755,024 | 7/1956 | Cox | 235/90 |

FOREIGN PATENT DOCUMENTS

| | | |
|---|---|---|
| 20038 | 8/1955 | Canada . |
| 20039 | 9/1955 | Canada . |
| 555175 | 4/1958 | Canada . |

*Primary Examiner*—John Gonzales
*Assistant Examiner*—Brian W. Brown
*Attorney, Agent, or Firm*—Beveridge, DeGrandi & Weilacher

[57] ABSTRACT

A cribbage board is provided with means to indicate when a losing player has failed to tally a given number of points in a game. The indicators are released to an indicating position by the placement of a tally pin in final socket on the game board surface.

3 Claims, 8 Drawing Figures

FIG. 5
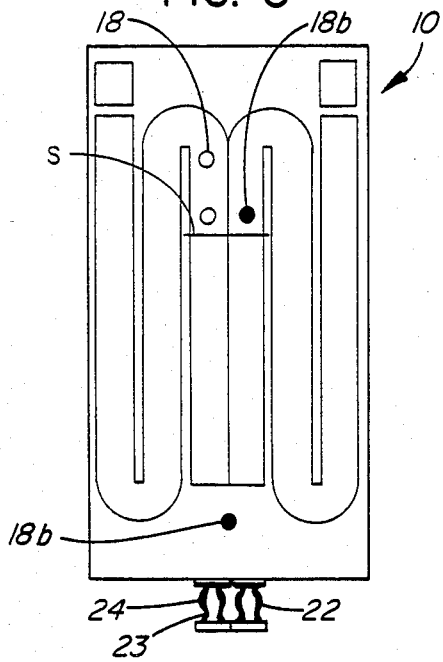
FIG. 6
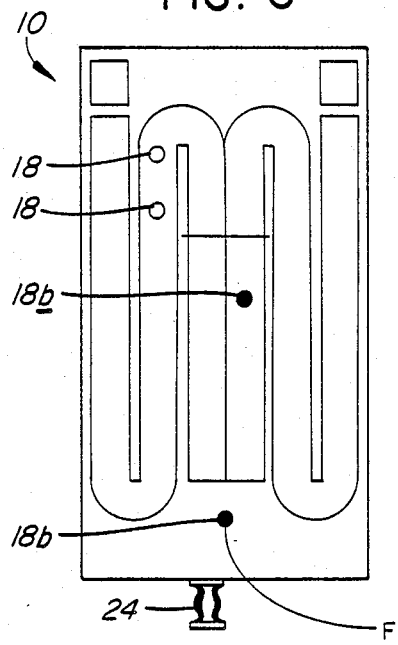
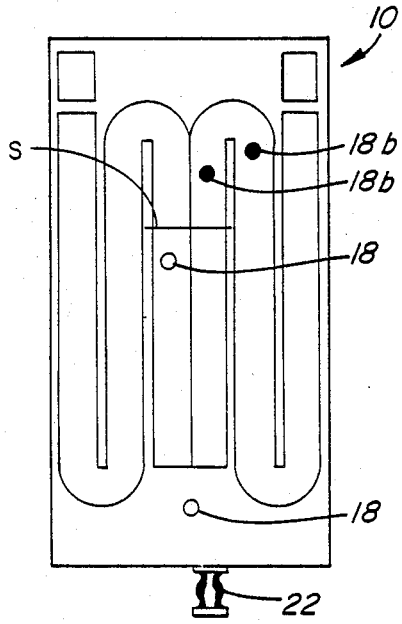
FIG. 7
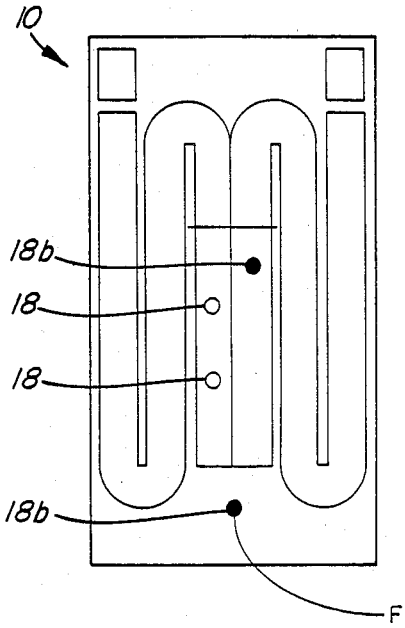
FIG. 8

CRIBBAGE BOARD

This invention relates to a cribbage board having means to indicate that a losing player has not attained a certain score in points.

In the game of cribbage, each player has a section of a cribbage scoring board with 120 tally pin holes and a single, 121st hole constitutes the finish, the player reaching it first being the winner. If the losing player fails to reach over 90 points he is classified as "skunked" and the winner is credited with two games.

The present invention provides a cribbage board which has means to indicate that a loser has been "skunked" when the winner places his tally pin in the 121st hole.

According to a broad aspect of the present invention, it relates to a cribbage board comprising an elongated rectangular game board having a plurality of spaced, parallel rows of tally pin receiving sockets in its upper surface, a pair of indicator means located within the confines of the board, means for retaining the indicator means in an inoperative position and means for moving at least one of the indicators from the inoperative position to an indicating, operative position beyond the end surface of the board.

The invention as illustrated by way of example in the accompanying drawings in which.

FIGS. 5 through 8 inclusive are plan, schematic views of the board showing the tally pins of the players in various positions with the response thereto of the indicator means.

Figure 1:
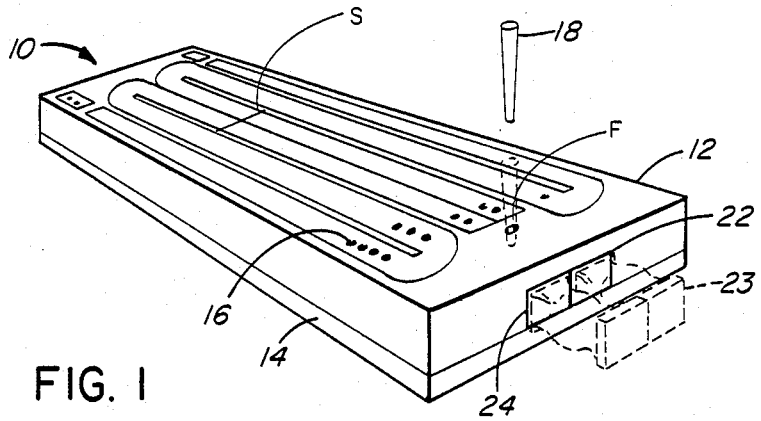
FIG. 1 is a perspective view of a cribbage board according to the invention.

Referring to FIGS. 1–4, the cribbage board 10 has an upper section 12 and lower section 14, the upper section being provided with a standard circuit of 240 sockets 16 arranged in parallel rows, 120 sockets being assigned to each player. A further, 121st socket denoted as F is the socket in which the winner places his tally pin 18 as shown in FIG. 1.

A line S is provided across the two center rows of sockets between the 90th and 91st socket of each player. This is referred to as the skunk line.

Figure 2:
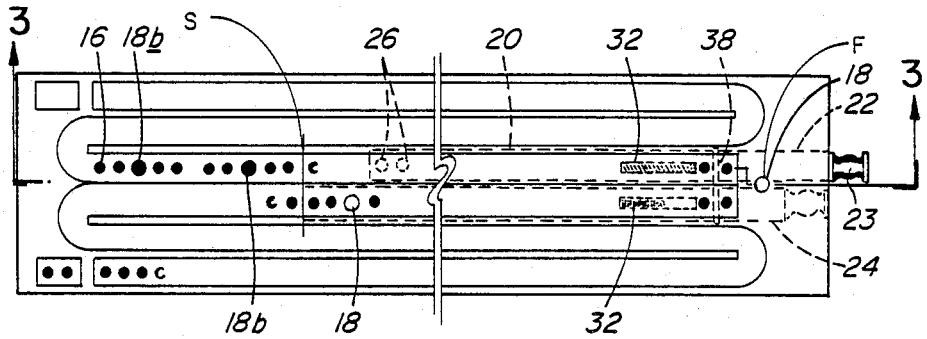
FIG. 2 is a plan view of the board in FIG. 1.
Figure 3:
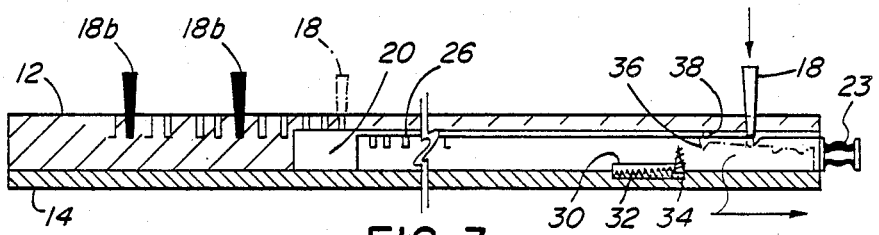
FIG. 3 is a sectional view taken along the line 3—3 of FIG. 2.
Figure 4:
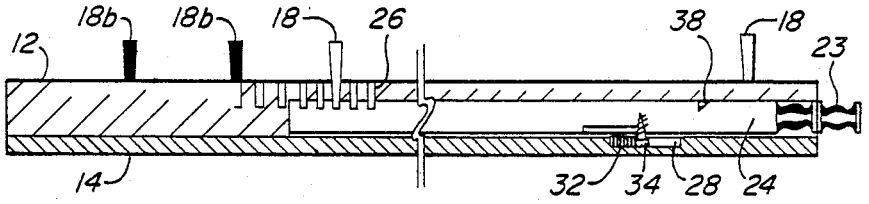
FIG. 4 is a sectional view similar to FIG. 3.

As shown in FIGS. 2, 3 and 4, the bottom 14 of the board closes a channel 20 which contains a pair of sliders 22, 24 the upper surfaces of which are provided with sockets 26 for receiving the tally pins 18 placed in the sockets 16 of the upper surface of the board, when the tally pins of one or both players are placed in the central row of socket 16 beyond the skunk line. For example, in FIG. 2 one white pin 18 of one player is placed in the 93rd socket and extends downwardly into the socket 26 of slider 24 as seen in FIG. 4. At the same time, black pins 18*b* of the other player are in the central row below the 90th socket and, as the other white pin 18 of the winner has been placed in the socket F, the slider 22 has been actuated with its indicating end 23 showing that the loser has been "skunked".

As shown clearly in FIGS. 3 and 4, the bottom 14 is provided with a pair of slots 28 in registry with similar slots 30 in the bottom of each of the sliders 22 and 24. Spring means 32 are arranged in each of the slots 28 and secured at one end to a screw 34 or other suitable fastener threaded into its associated slider 22 or 24.

As shown in FIG. 3, the upper surface of each slider is provided with a groove 36 which is engaged by a pin 38 in a position transverse of the upper end of the channel 20. It will be appreciated from FIGS. 2 and 3 that when the sliders 22 and 24 are placed in the channel and pressed inwardly to their FIG. 1 positions, the notches 36 in the upper ends of the slider are engaged by the pin 38 to retain each of the sliders in the inoperative position shown in solid line in FIG. 1. When the winner of the game has one of his pins in the sockets over 90 as in FIG. 2, the slider 24 is locked and cannot be released from the channel. However, as the winner places his white pin 18 in the socket F, the lower end of the pin pushes downwardly on the slider 22, releasing the groove 36 from the pin 38 and allowing the spring 32 to move the slider 22 to the outward position of FIGS. 2 and 3 so that the indicator end 23 shows that the loser has been skunked.

FIGS. 5 through 8 indicate several examples of the indicators 23 being actuated. In FIG. 5, a no contest game is indicated with the black peg 18*b* in the finishing hole F which releases both indicators 23 as the remaining pins are below the skunk line S.

In FIG. 6 both white pegs 18 are below the 90th socket. The black pins 18*b* are both over the skunk line S, thus releasing the indicator 23 on the white peg section of the board.

In FIG. 7, the clear pegs 18 are over the 90th socket and with one of them in the finishing aperture, the other indicator 23 is actuated.

In FIG. 8, both sets of pegs are over the skunk line S indicating the game is over but the loser has not been skunked.

While the invention has been described in connection with a specific embodiment thereof and in a specific use, various modifications thereof will occur to those skilled in the art without departing from the spirit and scope of the invention as set forth in the apended claims.

The terms and expressions which have been employed in this specification are used as terms of description and not of limitation. There is no intention in the use of such terms and expressions to exclude any equivalence of the features shown and described or portions thereof, but it is recognized that various modifications are possible within the scope of the invention claimed.

The embodiments of the invention in which an exclusive property or privilege is claimed are defined as follows:

1. A cribbage board comprising:

an elongated board having a plurality of spaced, parallel rows of tally pin receiving sockets in the upper surface thereof, said tally pin receiving sockets being arranged in two sequences, each sequence comprising a first and a second group of sockets;

a skunk line located between said first and second groups of sockets;

an elongated channel in said board;

a pair of elongated sliders located in parallel in said channel, each of said sliders having a plurality of tally pin receiving sockets therein, said plurality of tally pin receiving sockets being in registry with the second group of sockets in the associated sequence on the board, said sliders being movable from an inoperative position and having indicating means thereon visible in the operative position;

means to releasably retain said sliders in the inoperative position;

an additional tally pin receiving socket;

means to cause at least one of said sliders to move from the inoperative to the operative position when a tally pin is inserted into said additional socket and when all the sockets of said second group of sockets associated with said at least one slider are free of tally pins.

2. A cribbage board as claimed in claim 1 wherein said means to retain said sliders in the inoperative position comprises retaining pins.

3. A cribbage board as claimed in claim 2 wherein said means to cause said sliders to move from said inoperative to said operative positions comprises spring means, and wherein the insertion of a tally pin into said additional socket releases said sliders from said retaining pins.

* * * * *